US005466365A

United States Patent [19]

Savastano et al.

[11] Patent Number: 5,466,365

[45] Date of Patent: Nov. 14, 1995

[54] PROCESS FOR DEASPHALTING AND DEMETALLIZING PETROLEUM RESIDUES

[75] Inventors: Cesar Savastano, Zelo Buon Persico; Roberto Cimino, Milan, both of Italy

[73] Assignee: Eniricerche S.p.A., Milan, Italy

[21] Appl. No.: 197,281

[22] Filed: Feb. 16, 1994

[30] Foreign Application Priority Data

Feb. 24, 1993 [IT] Italy ..... MI93A0347

[51] Int. Cl.[6] ..... C10G 21/00

[52] U.S. Cl. ..... 208/309; 208/45; 208/86; 208/251 R

[58] Field of Search ..... 208/309, 251 R, 208/39, 319, 320, 45, 86

[56] References Cited

U.S. PATENT DOCUMENTS

| | | | |
|---|---|---|---|
| 3,186,938 | 6/1965 | Groli . | |
| 4,565,623 | 1/1986 | Davis . | |
| 5,346,615 | 9/1994 | Savastano | 208/309 |
| 5,354,454 | 10/1994 | Savastano et al. | 208/309 |

FOREIGN PATENT DOCUMENTS

| | | |
|---|---|---|
| 0254610 | 1/1988 | European Pat. Off. . |
| 0461694A1 | 12/1991 | European Pat. Off. . |
| 0504982A1 | 9/1992 | European Pat. Off. . |

OTHER PUBLICATIONS

Erdol & Kohle, Tetrochemie, Die Fallung von Asphaltenen aus Erdol–Destillationsruckstanden mit Kohlendioxid, vol. 40, No. 11, Nov. 1987, Leinfelden, pp. 486–488.

*Primary Examiner*—Anthony McFarlane
*Assistant Examiner*—Bekir L. Yildirim
*Attorney, Agent, or Firm*—Oblon, Spivak, McClelland, Maier & Neustadt

[57] ABSTRACT

A process for deasphalting and demetallizing petroleum vacuum distillation residues using dimethylcarbonate (DMC) in the presence of an overpressure of carbon dioxide ($CO_2$) and comprising:

mixing a vacuum distillation residue with dimethylcarbonate (DMC) under a pressure of $CO_2$, under temperature and pressure conditions such as to maintain the DMC in a prevalently liquid state, and forming a homogeneous solution with the deasphalted oils;

cooling the entire system to a temperature such as to form three phases;

then venting the gas at this temperature;

recovering a deasphalted and partly demetallized primary oil from the light phase;

recovering a deasphalted and partly demetallized secondary oil from the intermediate phase;

f) recovering the used DMC for its possible reuse.

8 Claims, No Drawings

PROCESS FOR DEASPHALTING AND DEMETALLIZING PETROLEUM RESIDUES

This invention relates to a process for deasphalting and demetallizing petroleum vacuum distillation residues. More particularly, the invention relates to a process for demetallizing and deasphalting said residues using dimethylcarbonate (DMC) in the presence of an overpressure of carbon dioxide.

Vanadium and other metals, such as nickel and iron, are present in crude oil mainly in the form of porphyrinic and asphaltenic complexes. The metal content and the ratio of the two types of complex depend essentially on the age of the crude and the severity of conditions during its formation. In some crudes, the vanadium content can reach 1200 ppm and the porphyrinic vanadium content can vary from about 20% to about 50% of the total vanadium.

The vanadium present in the crude has a deleterious effect on the refinery operations in that it represents a poison for catalysts used in catalytic cracking, hydrogenation and hydrodesulphurization. Vanadium present in fuel oil combustion products catalyzes the oxidation of sulphur dioxide to sulphur trioxide, leading to corrosion and the formation of acid rain. In addition metal porphyrins are relatively volatile and when the crude is vacuum-distilled tend to pass into the heavier fractions of the distillate. Hence traces of vanadium are usually found in vacuum-distilled gas oils.

In refinery operations it is usual to use deasphalted oil (DAO) as feed to the fluid catalytic cracking. Consequently the oil is subjected to preliminary deasphalting as the asphaltenes tend to form coke and/or consume large quantities of hydrogen. The asphaltene removal also results in removal of the asphaltenic vanadium and nickel and of organic compounds with heteroatoms, especially nitrogen and sulphur. Industrial practice is specifically to deasphalt the crude distillation residues (resid) with propane or by the ROSE (resid oil solvent extraction) process, which uses light hydrocarbons chosen from propane, n-butane and n-pentane. In this respect reference should be made to H. N. Dunning and J. W. Moore, "Propane Removes Asphalts from Crudes", Petroleum Refiner, 36 (5), 247–250 (1957); J. A. Gearhart and L. Gatwin, "ROSE Process Improves Resid Feed", Hydrocarbon Processing, May 1976, 125–128; and S. R. Nelson and R. G. Roodman, "The Energy Efficient Bottom of the Barrel Alternative", Chemical Engineering Progress, May 1985, 63–68.

Specifically, deasphalting with propane is conducted in RDC (rotating disk contactor) columns at an overhead temperature not exceeding 90° C. and a propane/oil ratio of between about 5/1 and about 13/1. Under these conditions a stream rich in light components and solvent is released as column overhead and a heavy stream consisting essentially of asphalt and solvent as column bottom product. Both the exit streams are subjected to a series of isothermal flash evaporations at decreasing pressure until a propane/oil ratio of the order of 1/1 is obtained. Further lowering of the propane content requires stripping usually with steam. The vaporized propane is condensed, compressed and recycled.

The ROSE process uses propane, iso or n-butane or n-pentane, to produce two streams similar to those of the propane process, and possibly a third stream rich in asphaltene resins. To recover the solvent the temperature is raised beyond the solvent critical temperature to cause separation of a condensed oily phase and a gaseous solvent phase.

The deasphalting efficiency in processes using propane is of the order of 75–83%, with an overall deasphalted oil recovery yield of the order of 50%.

These processes ore rather costly and complicated, requiring very large solvent quantities in relation to the hydrocarbon feedstock to be treated, their efficiency and yield are not completely satisfactory., they produce large asphaltene streams, and are unable to separate metals such as porphyrinic vanadium and nickel which are not totally eliminated with the asphaltene fraction. To remedy these drawbacks, processes have been proposed in the art based on the use of solvents other than hydrocarbon solvents, in particular those processes based on the use of polar solvents possibly under supercritical conditions, but these have not shown significant development.

U.S. Pat. No. 4,618,413 and 4,643,821 describe the extraction of porphyrinic vanadium and nickel from an oily product using various solvents including ethylene carbonate, propylene carbonate and ethylene thiocarbonate.

IT-A-22177 A/90 describes a process for demetallizing and deasphalting atmospheric petroleum distillation residues using DMC. In this process, contact between the crudes (or the atmospheric distillation residue) and the precipitating DMC occurs at close to atmospheric pressure, usually at a temperature close to the boiling point of DMC (the boiling point of DMC at atmospheric pressure is about 91° C.). This temperature has proved sufficiently high to ensure the necessary homogeneity of the system.

This latter process has the drawback of not being applicable to petroleum residues from distillation under reduced pressure. This is due to the fact that said pressure and temperature constraints do not allow the necessary homogeneity between the DMC and the residue to be achieved.

An improved process has now been found which overcomes the aforesaid drawbacks by using a combination of $CO_2$ overpressure and dimethylcarbonate at a temperature exceeding its boiling point at atmospheric pressure.

In accordance therewith the present invention provides a process for deasphalting and demetallizing petroleum vacuum distillation residues by precipitating the asphaltenes with dimethylcarbonate, characterised by being conducted in the presence of an overpressure of carbon dioxide and comprising the following steps:

a) mixing a vacuum distillation residue with dimethylcarbonate under a pressure of $CO_2$, under temperature and pressure conditions such as to maintain the dimethylcarbonate in a prevalently liquid state, with the formation of a homogeneous solution;

b) cooling said homogeneous solution to a temperature within the miscibility gap of the dimethylcarbonate/deasphalted and demetallized oil (DAO) system, with the formation and gravimetric stratification of three phases, namely: 1) an oil-rich light liquid phase; 2) a dimethylcarbonate-rich intermediate liquid phase; 3) a semisolid heavy phase containing essentially all the asphaltenes and a substantial part of the metals initially present in the vacuum distillation residue, in addition to a small amount of oil;

c) then venting the $CO_2$ at a temperature essentially equal to the temperature of step b) until a pressure close to atmospheric is reached;

d) recovering a deasphalted and partly demetallized primary from the light liquid phase;

e) recovering a deasphalted and partly demetallized secondary oil from the intermediate liquid phase;

f) recovering, and possibly reusing, the dimethylcarbonate from the light liquid phase, from the intermediate liquid phase and from the asphaltenic phase.

The term "asphaltenes" indicates the fraction insoluble in n-heptane, in accordance with IP 143.

The temperature and $CO_2$ overpressure required to obtain a homogeneous solution (step a) mainly depend on the composition of the residue under treatment and the DMC/feedstock ratio; usually the temperature is between 100° and 220° C. and the pressure between 30 and 200 bar, preferably between 60 and 170 bar. In all cases the temperature must be equal to or greater than the temperature of mutual solubility between-DMC and the residue. The preferred temperature range is 150°–200° C.

In implementing the present invention it is essential that the gas creating the overpressure is $CO_2$ and not any other inert gas, such as nitrogen. In this respect it will be shown hereinafter that the presence of $CO_2$ considerably improves the process, compared with nitrogen.

During mixing, there is no constraint on the time for which said components are kept in contact before the cooling of step b). Usually the mixing time is between a few minutes and a few hours. The DMC/residue weight ratio is generally between 4/1 and 15/1, and preferably between 6/1 and 12/1. With lower ratios the deasphaltation yield is too low, whereas with higher ratios a secondary deasphalted oil is obtained which is too diluted with DMC. Operating with a higher ratio is also a drawback in the case of an industrial plant, because of excessive capital and operating costs.

The temperature of step b), i.e. the temperature to which the $CO_2$-pressurized system consisting of DMC+residue is cooled, is chosen to allow phase separation in a wider region of the solubility envelope (i.e. towards lower temperatures), so maximizing phase separation. This temperature is preferably between 30° and 90° C., and even more preferably between 40° and 80° C.

In step b) three fractions are obtained, the lightest rich in oil and containing traces of asphaltenes, the intermediate rich in dimethylcarbonate and totally free of asphaltene, and the heaviest containing essentially all the asphaltenes in the form of a semisolid precipitate and a substantial part of the metals initially present in the vacuum distillation residue, plus small quantities of oil and DMC.

When the three phases have formed (step b) the carbon dioxide is vented (step c). This is done preferably gradually at a temperature less than the DMC boiling point at atmospheric pressure, preferably at a temperature about equal to that of step b). This $CO_2$ venting can be conveniently achieved by simply opening a valve in the top of the reactor.

The oil contained in the two liquid phases is recovered by conventional methods, for example by evaporating the residual DMC in a film evaporator under vacuum. In this manner the refined oil contained in the light phase (usually containing from 15 to 23% of DMC) can be purified by evaporation under vacuum at about 60° C., until a DAO is obtained with a DMC content less than 0.1%. The oil retained by the asphaltene precipitate can be recovered by washing with hot DMC. The residual DMC wetting the asphaltenes is removed by evaporation under reduced pressure.

The process of the present invention has the considerable advantage of being flexible in the sense that the yield can be varied by varying the $CO_2$ pressure and the DMC/feedstock ratio. This is an undoubted advantage because in this manner the asphaltene stream can be increased, so lowering its viscosity and with consequent increase in pumpability.

In addition the average Conradson carbon residue (CCR) of the DAO produced under a $CO_2$ overpressure follows an yield variation curve similar to that characteristic of the ROSE process using n-pentane. From 20.99% in the feedstock (equivalent to a yield of 100%), the CCR falls to 13.1% for a yield of around 72%, and to 10.1% for a 57% yield.

Finally, in tests with a $CO_2$ overpressure the residual Ni+V content was found to be less than in comparison tests carried out under nitrogen. Maximum Ni+V removal was found to be 78%, a value comparable with the demetallizing performance of the ROSE process using n-$C_4$ or n-$C_5$ under maximum DAO yield for each of these precipitating agents.

The following examples are given to better illustrate the present invention.

EXAMPLES

A vacuum distillation residue known as RV550+ Arabian Light is used, its characteristics being given in Table 1.

TABLE 1

Properties of RV550+ from Arabian Light

| | |
|---|---|
| density15/4 | 1.018 kg/dm$^3$ |
| kinematic viscosity | |
| (70° C.) | 5498 CST |
| (100° C.) | 641 cSt |
| crude base yield | 22.5 wt % |
| CCR | 20.99% |
| Ni—V—S content | 35 ppm–99 ppm - 4.2 wt % |
| asphaltene content | 6.1 wt % (IP 143) |
| SARA fractiondtion (for compound class of ASTM D-2007) of the fraction soluble in n-$C_5$: | |
| saturateds | 14.2 wt % |
| aromatics | 62.0 wt % |
| polars | 23.8 wt % |

The operating procedure is as follows: the feedstock is heated to the desired temperature in a 1 litre pressure vessel stirred at 200 rpm. The DMC, weighed out in the required quantities, is fed into the pressure vessel by the pressure of the gas used.

The gas arrives heated to the test temperature from an adjacent 3 litre pressure vessel maintained at 250 bar.

Zero time is considered to be the time at which contact between the residue, the DMC and the gas commences.

The system is kept stirring at the desired temperature for one hour. Approximately 70% of the reactor volume is filled in this manner.

With regard to the comparative test with nitrogen, an experimental scheme was devised comprising two variables (temperature and DMC/residue ratio) with three levels of action, in accordance with a chemimetric program based on central composite design, enabling optimum performance to be identified from the results of a small number of tests (13 in this case). The observed responses were the total DAO yield (R+E) and the asphaltene removal efficiency.

EXAMPLE 1

Comparative Example

This experiment was carried out as heretofore described, using a nitrogen overpressure of 30 bar.

The experimental results are given in Table 2. The residual Ni+V concentrations given in Table 2 are weight averages (on the total recovered DAO) of the concentrations corresponding to the raffinate and the extract of each test after removing the DMC by vacuum film evaporation. The overall DAO (R+E) yield varied from 61.6 wt % to 89 wt %. The asphaltene removal efficiency varied from a minimum of 15% to a maximum of 92 wt %. Ni+V removal did not exceed

TABLE 2

| Temp. °C. | DMC/ feed wt/wt | DAO yield wt % | Deasph effic. wt % | Ni total DAO averages ppm | V total DAO averages ppm | Demetall. effic. wt % |
|---|---|---|---|---|---|---|
| 200 | 5.0 | 84.7 | 69 | 18.3 | 47.1 | 51 |
| 150 | 7.0 | 87.9 | 88 | 17.2 | 55.1 | 46 |
| 200 | 7.0 | 88.3 | 68 | 25.8 | 81.0 | 20 |
| 150 | 7.0 | 84.9 | 92 | 16.8 | 56.2 | 46 |
| 150 | 7.0 | 89.0 | 86 | 18.1 | 60.4 | 41 |
| 150 | 9.0 | 85.4 | 86 | nd | nd | nd |
| 200 | 9.0 | 88.9 | 87 | 15.6 | 58.2 | 45 |
| 150 | 7.0 | 88.7 | 88 | 18.7 | 58.8 | 42 |
| 150 | 5.0 | 86.8 | 80 | 18.3 | 53.3 | 47 |
| 150 | 7.0 | 88.7 | 88 | 19.8 | 58.5 | 42 |
| 100 | 9.0 | 69.1 | 88 | 16.9 | 54.5 | 47 |
| 100 | 5.0 | 81.9 | 15 | 18.2 | 66.5 | 37 |
| 100 | 7.0 | 61.6 | 77 | 17.6 | 55.5 | 45 |

A regression analysis carried out on the data of Table 2 identified the point T=170° C., ratio=8/1, as the optimum for deasphalting efficiency and yield.

Three repeated tests carried out under the aforesaid conditions confirmed the predictions (Table 3). Varying the nitrogen pressure had no effect on the results, as proved by suitable tests.

TABLE 3

| Temper. ° C. | DMC/feed wt/wt | DAO yield wt % | Deasphalt. effic. % |
|---|---|---|---|
| 170 | 8 | 90 | 87 |
| 170 | 8 | 90 | 90 |
| 170 | 8 | 90 | 88 |

EXAMPLE 2

The vacuum residue used in Example 1 with the listed properties (Table 1) was treated as described in Example 1, except that the nitrogen was replaced by $CO_2$ and the total pressure was not fixed at a single value but became the third variable under investigation, together with the temperature and the DMC/feedstock ratio. The space defined by the three variables is represented by a cube bounded by the planes at p=30 bar and 120 bar, T=100° C. and 200° C., and ratio=3/1 and 9/1.

The tests 13–17 were preliminary tests to identify the optimum parameter range.

Four tests were carried out under the conditions of the cross vertices of the cube in the planes at p=30 bar and 120 bar (tests 1–4). A further three tests (tests 5–7) were carried out at the centre of the cube with coordinates 75 bar, 150° C., ratio 6/1. Test 8 was a repeat of test 4.

The best results for asphaltene and metal removal, even though with a lesser DAO yield, were obtained at the highest pressures and temperatures. Consequently four further tests (tests 9–12) were carried out at 75 bar and 165 bar, DMC/residue ratio 6/1 and 12/1 respectively, all four tests in the plane T=200° C. nominal. The operating conditions and results are shown in Table 4.

TABLE 4

| Test No. | Pressure nom. actual (bar) | Temperature nom. actual (°C.) | DMC/feed nom. actual | DAO yield wt % | Deasphalt. effic. wt % |
|---|---|---|---|---|---|
| 1 | 120:140 | 100:99 | 3.0:3.0 | 100. | 0. |
| 2 | 30:30 | 200:208 | 3.0:3.0 | 89.1 | 40.7 |
| 3 | 30:30 | 100:102 | 9.0:9.1 | 72.4 | 94.2 |
| 4 | 120:123 | 200:193 | 9.0:8.7 | 57.0 | 100. |
| 5 | 75:15 | 150:153 | 6.0:6.0 | 76.8 | 96.4 |
| 6 | 75:72 | 150:153 | 6.0:6.0 | 78.7 | 94.0 |
| 7 | 75:73 | 150:144 | 6.0:6.0 | 75.9 | 92.2 |
| 8 | 120:120 | 200:185 | 9.0:9.3 | 60.0 | 100. |
| 9 | 165:143 | 200:183 | 6.0:3.0 | 100. | 0. |
| 10 | 75:62 | 200:192 | 12.0:11.9 | 82.4 | 96.5 |
| 11 | 165:170 | 200:183 | 12.0:12.2 | 80.3 | 95.3 |
| 12 | 75:74 | 200:193 | 6.0:6.0 | 80.8 | 100. |
| 13 | 120:123 | 170:165 | 8.0:8.1 | 52.0 | 96.9 |
| 14 | 200:230 | 170:156 | 8.0:8.1 | 74.0 | 0. |
| 15 | 30:30 | 100:102 | 8.0:8.0 | 64.2 | 90.0 |
| 16 | 30:34 | 170:174 | 8.0:8.0 | 85.8 | 91.4 |
| 17 | 100:106 | 200:187 | 3.0:3.0 | 73.4 | 97.3 |

The results of the analyses carried out on the extract are shown in Table 5.

TABLE 5

(Extract)

| Test No. | Yield (wt %) | CCR (wt %) | Ni (ppm) | V (ppm) |
|---|---|---|---|---|
| 1 | 6. | 14.30 | 5.9 | 30.9 |
| 2 | 9.0 | 15.15 | 5.4 | 35.0 |
| 3 | 16.5 | 15.69 | 6.3 | 46.0 |
| 4 | 15.1 | 12.13 | 4.4 | 33.0 |
| 5 | 13.5 | 13.65 | 5.1 | 39.4 |
| 6 | 13.8 | 14.21 | 5.8 | 41.0 |
| 7 | 13.7 | 14.17 | 5.6 | 40.8 |
| 8 | 16.5 | 13.40 | 5.1 | 49.3 |
| 9 | 6. | nd | nd | nd |
| 10 | 24.2 | 12.95 | 5.7 | 38.2 |
| 11 | 20.5 | 13.28 | 5.4 | 37.7 |
| 12 | 12.8 | 15.74 | 6.5 | 44.9 |
| 13 | 17.0 | nd | 5.6 | 33.3 |
| 14 | 12.0 | nd | nd | nd |
| 15 | 15.2 | nd | nd | nd |
| 16 | 16.6 | nd | 6.6 | 39.0 |
| 17 | 6.7 | nd | 5.5 | 38.0 |

Table 6 shows the results of the same analyses carried out on the raffinate.

TABLE 6

(Raffinate)

| Test No. | Yield (wt %) | CCR (wt %) | Ni (ppm) | V (ppm) |
|---|---|---|---|---|
| 1 | 94 | 21.21 | 31.0 | 106 |
| 2 | 80.2 | 18.41 | 21.8 | 74 |
| 3 | 56.0 | 12.26 | 9.2 | 34 |
| 4 | 41.9 | 9.35 | 5.2 | 22 |
| 5 | 63.3 | 13.01 | 9.2 | 37 |
| 6 | 64.9 | 12.80 | 9.4 | 38 |
| 7 | 62.2 | 12.91 | 9.1 | 37 |
| 8 | 43.6 | 9.49 | 7.0 | 26 |
| 9 | 94. | nd | nd | nd |
| 10 | 58.2 | 14.59 | 12.9 | 47.8 |
| 11 | 60.0 | 10.10 | 6.9 | 27.3 |
| 12 | 68.0 | 14.49 | 12.1 | 47 |
| 13 | 35.0 | nd | 5.9 | 23.4 |
| 14 | 61.0 | nd | nd | nd |
| 15 | 49.0 | nd | nd | nd |

TABLE 6-continued

| Test No. | Yield (wt %) | CCR (wt %) | Ni (ppm) | V (ppm) |
|---|---|---|---|---|
| | | (Raffinate) | | |
| 16 | 69.2 | nd | 14.8 | 53 |
| 17 | 66.7 | nd | 12. | 37 |

Finally, Table 7 shows the average values for the total recovered deasphalted oil (raffinate+extract)

TABLE 7

| Test No. | CCR (wt %) | Ni + V (ppm) | Demet. effic. (%) |
|---|---|---|---|
| | | (Average values) | |
| 1 | 20.8 | 131 | 2 |
| 2 | 18.1 | 90 | 33 |
| 3 | 13.1 | 44 | 67 |
| 4 | 10.1 | 30 | 78 |
| 5 | 13.1 | 46 | 66 |
| 6 | 13.0 | 47 | 65 |
| 7 | 13.1 | 46 | 66 |
| 8 | 10.6 | 39 | 71 |
| 9 | nd | nd | nd |
| 10 | 14.1 | 56 | 58 |
| 11 | 11.0 | 37 | 72 |
| 12 | 14.7 | 58 | 57 |
| 13 | nd | 32 | 76 |
| 14 | nd | nd | nd |
| 15 | nd | nd | nd |
| 16 | nd | 64 | 52 |
| 17 | nd | 49 | 63 |

The data of FIG. 7 clearly show the influence of the $CO_2$ pressure both on the yield and on the Ni and V content of the recovered oil. In contrast, if using nitrogen (Example 1) these parameters do not vary with the $N_2$ pressure.

The highest level of demetallization, equal to 78%, corresponds to an extract plus raffinate oil yield of 57% (test 4).

We claim:

1. A process for deasphalting and demetallizing petroleum vacuum distillation residues using dimethylcarbonate in the presence of an overpressure of carbon dioxide and comprising the following steps:

a) mixing a vacuum distillation residue with dimethylcarbonate under a pressure of $CO_2$, under temperature and pressure conditions such as to maintain the dimethylcarbonate in a prevalently liquid state, with the formation of a homogeneous solution;

b) cooling said homogeneous solution to a temperature within the miscibility gap of the dimethylcarbonate/deasphalted and demetallized oil (DAO) system but lower than the boiling point of dimethylcarbonate at atmospheric pressure, with the formation and gravimetric stratification of three phases, namely:

1) an oil-rich light liquid phase;

2) a dimethylcarbonate-rich intermediate liquid phase;

3) a semisolid heavy phase containing essentially all the asphaltenes and a substantial part of the metals initially present in the vacuum distillation residue, in addition to a small amount of oil;

c) then venting the $CO_2$ at a temperature essentially equal to the temperature of step b) until a pressure close to atmospheric is reached;

d) recovering a deasphalted and partly demetallized primary oil from the light liquid phase;

e) recovering a deasphalted and partly demetallized secondary oil from the intermediate liquid phase;

f) recovering, and possibly reusing, the dimethylcarbonate from the light liquid phase, from the intermediate liquid phase and from the asphaltenic phase.

2. A process as claimed in claim 1, characterised in that the mixing step a) is conducted at a $CO_2$ pressure of between 30 and 200 bar, a temperature of between 100° and 220° C., and a dimethylcarbonate/residue weight ratio of between 4/1 and 15/1.

3. A process as claimed in claim 2, characterised in that the mixing step a) is conducted at a $CO_2$ pressure of between 60 and 170 bar, a temperature of between 150° and 200° C., and a dimethylcarbonate/residue weight ratio of between 6/1 and 12/1.

4. A process as claimed in claim 1, characterised in that step b) is conducted at a temperature of between 30° and 90° C.

5. A process as claimed in claim 4, characterised in that step b) is conducted at a temperature of between 40° and 80° C.

6. A process as claimed in claim 1, characterised in that step c) is conducted at a temperature less than the boiling point of dimethylcarbonate at atmospheric pressure.

7. A process as claimed in claim 6, characterised in that step c) is conducted at a temperature of between 30° and 90° C.

8. A process as claimed in claim 7, characterised in that step c) is conducted at a temperature of between 40° and 80° C.

* * * * *